United States Patent [19]

Jones

[11] Patent Number: 4,669,689

[45] Date of Patent: Jun. 2, 1987

[54] BAG HOLDER

[76] Inventor: Frederick L. Jones, 1777 SE. 15th St., Fort Lauderdale, Fla. 33316

[21] Appl. No.: 868,598

[22] Filed: May 30, 1986

[51] Int. Cl.[4] ..... B65B 67/04

[52] U.S. Cl. ..... 248/99; 248/152

[58] Field of Search ..... 248/99, 100, 101, 95, 248/152; 53/590, 384; 141/390, 391; 40/124.4

[56] References Cited

U.S. PATENT DOCUMENTS

| | | | |
|---|---|---|---|
| 1,760,752 | 5/1930 | Happer | 248/99 |
| 1,827,495 | 10/1931 | Tippett | 248/99 |
| 1,923,816 | 8/1933 | Firl | 248/100 X |
| 2,159,357 | 5/1939 | Lowenstein | 40/124.4 |
| 2,513,239 | 6/1950 | Hatchett | 40/124.4 |
| 3,646,723 | 3/1972 | Meroney | 141/390 X |
| 3,936,087 | 2/1976 | Alexander | 248/99 X |
| 4,052,764 | 10/1977 | Groff | 248/99 X |
| 4,445,658 | 5/1984 | Ferron | 248/99 |
| 4,537,377 | 8/1985 | Shewchuk | 248/99 |

FOREIGN PATENT DOCUMENTS

| | | | |
|---|---|---|---|
| 2437326 | 2/1976 | Fed. Rep. of Germany | 248/99 |
| 120020 | 10/1970 | Norway | 248/100 |

*Primary Examiner*—J. Franklin Foss

[57] ABSTRACT

A bag holder for mounting on a vertical surface holds open a limp plastic film bag. The opening is maintained by holders fitting into the handle holes in the bag and spreading them apart. A flap fits into the bag opening on one side to further open the bag and to form a backboard to deflect thrown refuse into the bag.

8 Claims, 7 Drawing Figures

BAG HOLDER

BACKGROUND OF THE INVENTION

Field of the Invention

This invention relates to devices for holding a plastic bag in an open position and, more particularly, to such devices that fasten to a vertical surface and provide a backboard to further hold open and to guide refuse into the bag.

In the past it was usual practice for grocery stores to provide stiff paper bags for their merchandise. Householders reused these bags to hold household refuse as it accumulated. Grocery stores now frequently substitute thin plastic film bags with two holes that form handle loops. Although these bags are more water resistant, they are too limp to be used in the same manner as the paper bags. Various devices have been disclosed to hold these plastic film bags open to serve as waste receptacles. Search of the prior art revealed the following U.S. Pat. Nos. 4,537,377; 4,512,540; 4,467,898; 4,458,867; 4,445,658; 4,418,835; 4,407,474; 4,332,361; 4,199,122; 4,062,170. The above inventions do not provide the advantages of the instant invention.

SUMMARY OF THE INVENTION

In a preferred embodiment of the invention, a device is provided for fastening to a vertical surface such as a wall or the inside of a kitchen cabinet door. The device holds a limp plastic bag open at the top of the bag to serve as a refuse receptacle. It is designed for use with plastic film bags having a pair of holes near its upper margin forming handle loops for carrying the loaded bag. The instant invention provides a pair of protuberances that engage the holes to hold the bag mouth open. Also provided is a backboard with flag that serves two purposes.

It provides a third holding open means operating in concert with the two protuberances to increase the width of the opening of the bag mouth. The protuberances are mounted on springably opposed arms that pull the bag length open between the handle loops while the flap increases the width of the opening. In addition it provides a backboard to direct carelessly thrown refuse into the bag opening. In alternate embodiments it also provides a means for storing a supply of plastic bags. It may also provide means for mounting a picture on the backboard or flap. This may be used for mounting the picture of an individual disliked by the public.

It is an object of the invention to provide a device that will lock the bag in place by a simple design of the protuberance so that they do not release accidentally. It is a further object to provide a device that can be cut from a single sheet of material and be bent to desired form for economy of manufacture. It is a further object to provide devices that will nest together for efficient storage and shipping. It is a further object to provide protuberances that will springably hold open the mouth of the bag to maximize the opening.

DESCRIPTION OF PREFERRED EMBODIMENTS

Figure 2:
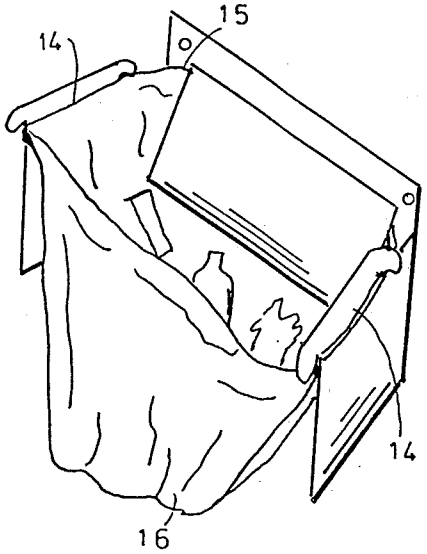
FIG. 2 is a perspective view of the invention with a bag in place.
Figure 1:
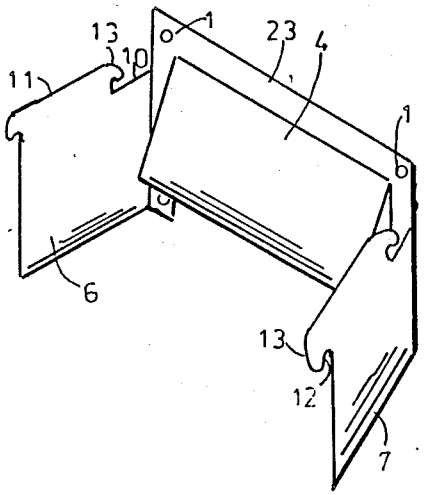
FIG. 1 is a perspective view of the invention.
Figure 4:
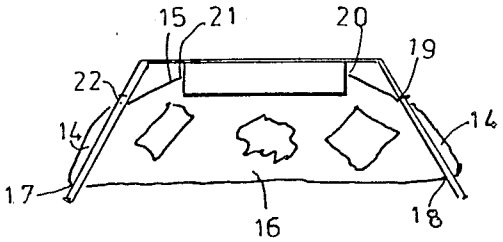
FIG. 4 is a plan view of the invention with bag in place.
Figure 5:
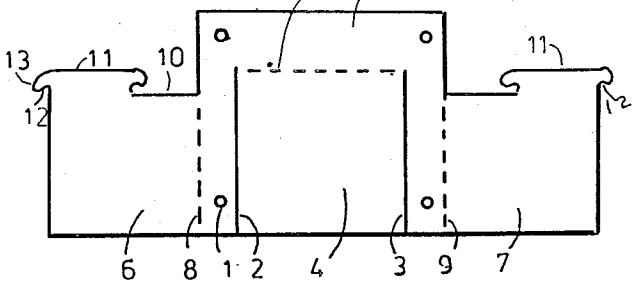
FIG. 5 is a front elevation of the invention before bending various parts.
Figure 3:
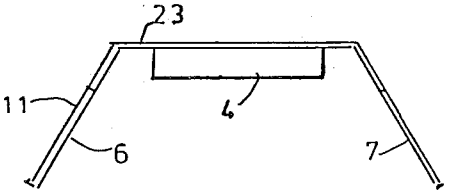
FIG. 3 is a plan view of the invention with bag in place.

Referring first to FIG. 5, a sheet of a springy plastic such as a polyolefin is shown that has been die cut to the desired shape to make the invention when various parts are bent to the final configuration. Holes 1 are punched in the sheet. These holes accommodate fasteners (screws) to fasten the finished device to a vertical surface such as a wall or the inside of a kitchen cabinet door, for example. Slits 2 and 3 are cut to form flap 4. The flap 4 is bent up (out of the plane of the paper) along the dotted line 5 to an angle of approximate 20°. The two arms 6 and 7 are bent up (out of the plane of the paper) to an angle of approximately 40° along the dotted lines 8 and 9 respectively. The device after bending is shown in perspective in FIG. 1 and in plan view in FIG. 3. The invention in use with a bag in place is shown in perspective in FIG. 2 and in plan view in FIG. 4 with refuse in the bag. Holders 11 are protuberances formed on the upper edges 10 of arms 6 and 7. They are shaped with a gentle down-curving at each end 13, and the ends 13 spaced apart sufficiently to permit the hand hole 14 to be spread apart when slid over the holder. The end 13 terminates in an inward and upward curve 12 so shaped as to resist disengaging when the bag is lifted. The bag is installed by sliding a side wall 15 of the bag 16 under the flap 4, and then stretching each of the two hand holes 14 over the holders 11 on arms 6 and 7. The arms 6 and 7 are springable and the angles and spacings are arranged to provide slight tension along the open rim of the bag 16 when it is stretched open by the holders 11 of the arms 6 and 7 and the flap 4.

The bag then forms a polygon including a first side between points 17 and 18; a second side between points 18 and 19 representing the handle loop stretched on the holder 11; a third side between points 19 and 20; a fourth side between points 20 and 21 representing the bag edge under flag 4; a fifth side between points 21 and 22 and a sixth side between points 22 and 17 representing the second handle loop. This polygonal upper edge of the bag provides a large opening for receiving refuse. Furthermore, the flap 4, covering a side of the bag against the vertical supporting wall, acts as a guide or backboard to direct refuse into the bag when it strikes the flap 4 or the top of the plate 23 from a misdirected throw. This further improves the utility of the invention in converting the limp plastic bag into a practical waste receptacle.

Figure 6:
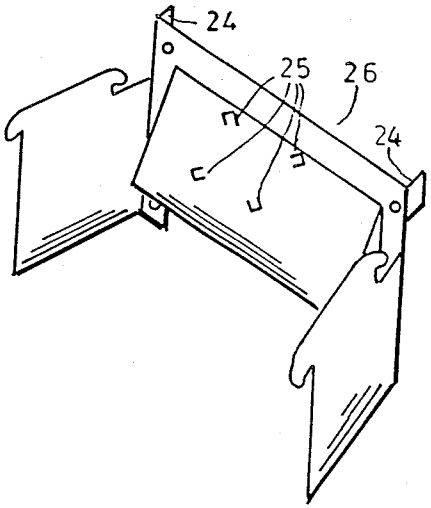
FIG. 6 is a perspective view of another embodiment of the invention.
Figure 7:
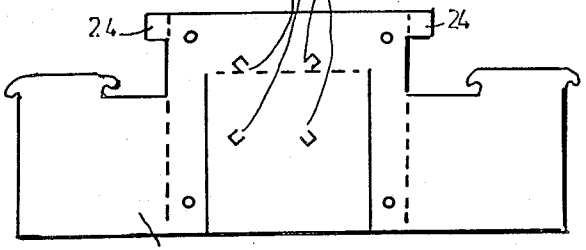
FIG. 7 is a front elevation of the invention of FIG. 6 before bending various parts.

FIGS. 6 and 7 show an alternate embodiment of the invention including bag storage flaps 24 that are folded down below the plane of the paper of FIG. 7 along the dotted lines 26 to hold the top 23 away from the vertical supporting wall, to which it may be fastened, enough to form the space 26 that is large enough to store several bags for future use.

Picture holder means 25 may also be provided to hold a picture. The holder means shown for illustration is flaps that hold the corners of a picture, but other picture holding means, well known in the art, may be alternatively employed. It is anticipated that one would mount the picture of a person disliked to encourage throwing refuse at it and thereby into the container to improve sanitation.

The invention may be fabricated by other means well known in the art such as vacuum thermoforming or injection molding. Alternatively, the invention may be stamped out of metal sheet.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A bag holder adapted for mounting on a vertical surface for holding open a limp plastic film bag, said bag having a pair of spaced oppositely extending walls each with a handle loop portion formed by an aperture in said wall, comprising:

vertical surface plate means adapted for mounting to said vertical surface;

a pair of bracket arms coextensive with and springably supported by said vertical surface plate means, spaced opposite from each other and each extending at an acute angle from the plane of said plate means so that the distance between said arms increases with distance away from said plate means;

bag aperture engaging means mounted on top of each of said bracket arms for engaging said apertures in said bag;

a flap means coextensive with and supported by said plate means at the upper margin of said flap means and extending downwardly therefrom at an acute angle to the plane of said plate means so as to be spaced farther from said vertical surface with distance below said upper margin, said flap means adapted for engaging a wall of said bag means when inserted between said flap means and said vertical surface, said bracket arms being springably opposed to cause said bag aperture engaging means to pull open said bag when said apertures are engaged, and said aperture engaging means and said flap means being positioned relative to one another so as to hold the mouth of said bag open between the pair of said aperture engaging means and under said flap means to provide a larger and more useful opening, said plate means and said flap means joining together to form a continuous smooth surface to serve as a backboard to direct thrown items into said bag.

2. The invention of claim 1 cut from a single sheet of material and bent to shape.

3. The invention of claim 1 made from a polyolefin plastic.

4. The invention of claim 1 including spacing means connected to said plate means for spacing the upper portion of said plate means away from said vertical surface to provide storage space for storing bags.

5. The invention of claim 1 including picture mounting means attached to said flap means.

6. The invention of claim 1 including picture mounting means attached to said plate means.

7. The invention of claim 1 shaped to provide close nesting of a plurality of said bag holders for economy in storage, packaging and shipping.

8. In the invention of claim 1, said bag aperture engaging means having two ends spaced apart a distance substantially equal to said bag aperture when stretched, each said end having a gently downward curving upper portion coextensive with an upwardly and inwardly curving lower portion to securely engage said aperture.

* * * * *